US008608034B2

(12) United States Patent
Bloom

(10) Patent No.: US 8,608,034 B2
(45) Date of Patent: Dec. 17, 2013

(54) DISPENSING VALVE

(75) Inventor: Kenneth S. Bloom, Bloomdale, OH (US)

(73) Assignee: Berry Plastics Corporation, Evansville (IN)

( * ) Notice: Subject to any disclaimer, the term of this patent is extended or adjusted under 35 U.S.C. 154(b) by 223 days.

(21) Appl. No.: 13/030,198

(22) Filed: Feb. 18, 2011

(65) Prior Publication Data

US 2012/0211530 A1 Aug. 23, 2012

(51) Int. Cl.
*B65D 5/72* (2006.01)

(52) U.S. Cl.
USPC ..... 222/490; 222/494; 220/212

(58) Field of Classification Search
USPC ..... 222/490–494
See application file for complete search history.

(56) References Cited

U.S. PATENT DOCUMENTS

| | | | | |
|---|---|---|---|---|
| 1,859,382 | A * | 5/1932 | Cruze | 222/490 |
| 3,754,690 | A * | 8/1973 | Marchant | 222/494 |
| 3,822,720 | A | 7/1974 | Souza | |
| 4,506,809 | A * | 3/1985 | Corsette | 222/213 |
| 4,749,108 | A | 6/1988 | Dornsbusch et al. | |
| 4,991,745 | A | 2/1991 | Brown | |
| 5,267,673 | A * | 12/1993 | Crosnier et al. | 222/321.7 |
| 5,271,531 | A | 12/1993 | Rohr et al. | |
| 5,531,363 | A | 7/1996 | Gross et al. | |
| 5,743,443 | A | 4/1998 | Hins | |
| 5,839,614 | A | 11/1998 | Brown et al. | |
| 5,897,033 | A | 4/1999 | Okawa et al. | |
| 5,924,605 | A | 7/1999 | Baudin et al. | |
| 5,927,566 | A | 7/1999 | Mueller | |
| 6,230,940 | B1 | 5/2001 | Manning et al. | |
| 6,405,901 | B1 | 6/2002 | Schantz et al. | |
| 6,450,375 | B1 | 9/2002 | Hins et al. | |
| 6,672,487 | B1 | 1/2004 | Lohrman | |
| 6,951,295 | B1 * | 10/2005 | Gaus et al. | 222/484 |
| 7,128,245 | B2 | 10/2006 | Lee | |
| 7,255,250 | B2 * | 8/2007 | Pugne | 222/556 |
| 7,503,469 | B2 | 3/2009 | Bloom et al. | |
| 2003/0094467 | A1 * | 5/2003 | Dark | 222/484 |
| 2006/0201976 | A1 | 9/2006 | Bloom et al. | |
| 2008/0237278 | A1 | 10/2008 | Gaus et al. | |
| 2009/0127294 | A1 * | 5/2009 | Krallmann | 222/494 |
| 2009/0188950 | A1 | 7/2009 | Gaus et al. | |

FOREIGN PATENT DOCUMENTS

| | | | |
|---|---|---|---|
| DE | 4403080 | A1 | 8/1995 |
| DE | 19510007 | A1 | 10/1995 |
| DE | 4440211 | C1 | 2/1996 |
| GB | 2324297 | A | 10/1998 |
| WO | WO 95/21098 | | 8/1995 |

* cited by examiner

*Primary Examiner* — Paul R Durand
*Assistant Examiner* — Randall Gruby
(74) *Attorney, Agent, or Firm* — Barnes & Thornburg LLP

(57) ABSTRACT

A dispensing valve includes a resiliently flexible mounting portion, a resiliently flexible opening portion disposed radially inwardly of the mounting portion, and a resiliently flexible intermediate portion disposed radially between and coupled to the mounting and opening portions, and extending both radially outwardly and axially to form a first radial space between the opening and isolating portions, and spaced radially inwardly of the mounting portion to form a second radial space between the mounting and intermediate portions. The mounting portion includes an annular rib extendable axially outward with respect to the opening portion to limit axial movement of the opening portion during dispensing and venting of the valve.

45 Claims, 3 Drawing Sheets

DISPENSING VALVE

The present disclosure is directed to dispensing valves, to dispensing closures that include such valves, and to packages that include such closures.

BACKGROUND AND OBJECTS OF THE DISCLOSURE

U.S. Pat. No. 6,672,487 discloses a dispensing package for fluid products. A container has a body for holding a product to be dispensed and has a finish extending from the body with an open mouth. A closure base includes a ledge with a skirt externally secured to the finish and a cylindrical wall extending from the ledge coaxially with the mouth. A collar has a deck with a central opening aligned with the mouth, a first cylindrical wall surrounding the opening and extending away from the mouth, and a second cylindrical wall externally surrounding and secured to the cylindrical wall on the base. A lid is integrally connected to the collar or the base by at least one hinge. A dispensing valve of flexible resilient elastomeric construction has a peripheral portion captured between the collar deck and the base cylindrical wall for securing the valve in position and simultaneously functioning as a seal between the base and the collar. The valve also has an intermediate portion underlying the collar deck, and an annular wall portion extending from an inner end of the intermediate portion radially inwardly adjacent to an inner surface of the first cylindrical collar wall. The valve further has an inner portion extending radially inwardly from the annular wall portion, and at least one dispensing slit in the inner portion.

U.S. Pat. No. 7,503,469 discloses a dispensing valve that includes an annular ring of relatively rigid molded plastic construction, and a flexible resilient valve element integrally molded onto the ring, and the ring and the valve element have at least one mechanical interlock to secure the valve element to the ring as the valve element is molded onto the ring. The mechanical interlock includes openings in an inner periphery of the annular ring and portions of the valve element molded into the openings. The inner periphery of the ring includes an annular ledge, and the openings are through-openings disposed in an angularly spaced array around the ledge. Each of the openings includes an enlarged portion opening at one axially facing surface of the ledge and an ensmalled portion aligned with the enlarged portion and opening to a second axially facing surface of the ledge.

One or more general objects of the present disclosure, in accordance with one aspect of the disclosure, include providing a dispensing valve that is made of one piece and is not retained to a closure by a separate rigid retainer collar or mounting ring, may be recycled with a closure, may include an opening portion and a mounting portion coupled to the mounting portion and having an annular rib to limit axial movement of the opening portion during dispensing and venting of the valve.

The present disclosure embodies a number of aspects that can be implemented separately from or in combination with each other.

A dispensing valve system in accordance with one aspect of the disclosure includes a base of relatively rigid plastic construction, and having a dispensing opening, an annular recess surrounding said dispensing opening, and an annular wall separating said recess from said dispensing opening. The system also includes a dispensing valve of one-piece one-material flexible resilient molded plastic construction, and including a center portion disposed within said annular wall and having at least one dispensing slit, and a peripheral portion attached to said base and including an annular rib extending into said annular recess for movement radially inwardly and outwardly within said recess as a function of motion of said central portion of said dispensing valve thereby to limit axial movement of said central portion during dispensing and venting at said valve. Preferably, the center portion may include one or more slits.

In accordance with another aspect of the disclosure, a dispensing valve includes a resiliently flexible mounting portion, and a resiliently flexible opening portion disposed radially inwardly of the mounting portion. The valve also includes a resiliently flexible intermediate portion disposed radially between and coupled to the mounting and opening portions, and extending both radially outwardly and axially to form a first radial space between the opening and isolating portions, and spaced radially inwardly of the mounting portion to form a second radial space between the mounting and intermediate portions. The mounting portion includes an annular rib extendable axially outward with respect to the opening portion to limit axial movement of the opening portion during dispensing and venting of the valve.

In accordance with a further aspect of the disclosure, a one-piece one-material dispensing valve includes a resiliently flexible mounting portion including a radially outward annular wall, and a resiliently flexible opening portion disposed radially inwardly of said mounting portion, and including a radially inward annular wall, a web extending radially inwardly of said radially inward annular wall, and at least one slit in said web. The valve also includes a resiliently flexible isolating portion disposed radially between and coupled to said mounting and opening portions, and extending both radially outwardly and axially to form a first radial space between said isolating portion and said radially inward annular wall of said opening portion, and spaced radially inwardly of said radially outward annular wall of said mounting portion to form a second radial space between said isolating portion and said radially outward annular wall of said mounting portion. The isolating portion includes at least a radially intermediate annular wall, and said radially outward annular wall is cantilevered from said radially intermediate annular wall. The mounting portion includes an annular rib extending axially outward with respect to said opening portion and extendable into an annular recess of a closure housing for movement radially inwardly and outwardly within said recess as a function of motion of said central portion of said dispensing valve thereby to limit axial movement of said central portion during dispensing and venting at said valve.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
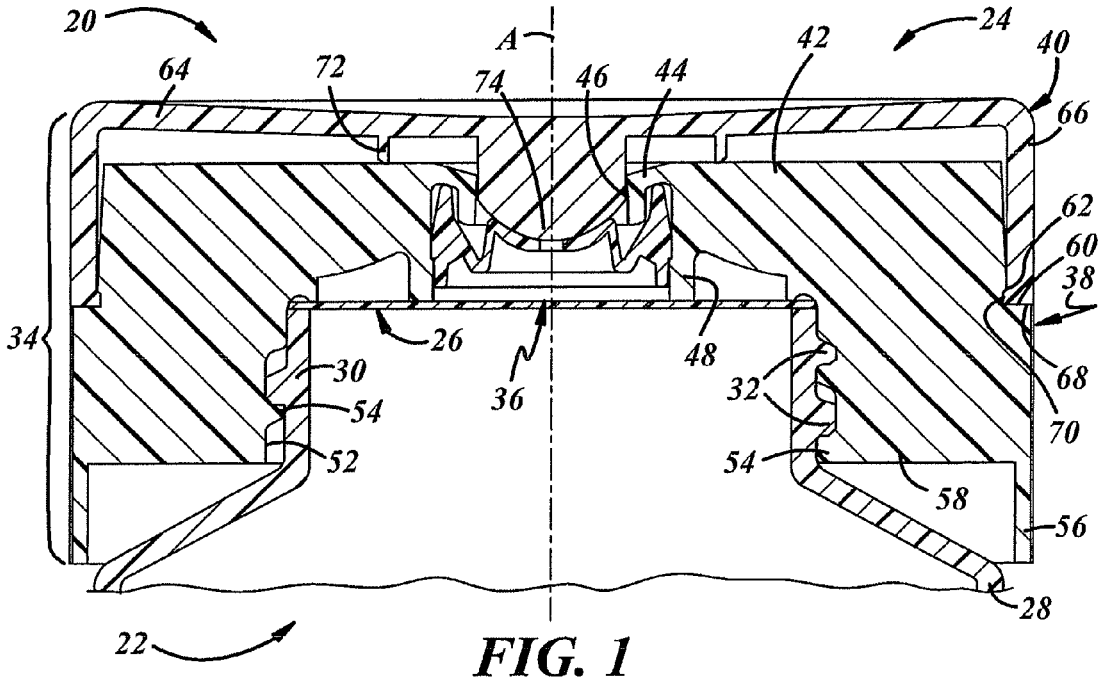
FIG. 1 is a fragmentary sectional view diametrically bisecting a package of an exemplary embodiment of the present disclosure.

FIG. 1 illustrates a dispensing package 20 in accordance with one presently preferred embodiment of the disclosure as comprising a container 22 and a dispensing assembly 24 secured to the container 22. The package 20 may be used to contain and dispense any suitable product, for example, fluid products such as beverages, body lotions, and food condiments, for instance, ketchup, mustard, mayonnaise, or the like. Also, a liner 26 may be disposed between the container 22 and the dispensing assembly 24 in any suitable manner. The package 20 extends along a longitudinal axis A.

The container 22 may be of one-piece integrally molded plastic construction and may be composed of any suitable container material compatible with the product to be contained. The container 22 has a flexible resilient body 28 for holding product to be dispensed, and for being squeezed from its state of rest to dispense product and being released from its squeezed state to automatically return to its state of rest to withdraw residual product back into the container 22. A cylindrical neck finish 30 extends from the body 28 and surrounds and establishes a container mouth. The neck finish 30 may include one or more engagement elements, for example, threads or beads 32 for securing the dispensing assembly 24 to the container 22. As used herein, the term threads includes one or more threads or thread segments that may be continuous or discontinuous and may or may not extend around the entire circumference of the neck finish 30.

As shown in FIG. 1, the dispensing assembly 24 may be a two-piece assembly that includes a dispensing structure, for example a base, housing, or shell 34, to which a dispensing valve 36 is secured. Although illustrated as a closure shell 34, the dispensing structure may instead include a portion of a container.

In the illustrated embodiment, the shell 34 may be of one-piece integrally molded plastic construction, and may be composed of any suitable material compatible with the product to be contained and dispensed. For example, the shell 34 may be composed of polypropylene, polyethylene, polypropylene copolymer, polyethylene copolymer, or any other suitable thermoplastic or thermoplastic-copolymer.

The dispensing valve 36 may be of one-piece one-material flexible resilient molded plastic construction, and may be composed of any suitable plastic material compatible with the product to be contained and dispensed. For example, the valve 36 may be composed of an elastomeric material that is recyclable with the material of the shell 34. In another example, the valve 36 may be composed of an elastomeric material that is melt compatible or melt processable with the shell 34. Although the valve 36 is preferably composed of a thermoplastic or a thermoplastic elastomer, the valve 36 may be composed of any suitable polymeric material.

The shell 34 preferably includes a base 38 of relatively rigid plastic construction to which a lid 40 may be pivotally secured by a hinge (not shown). The hinge may be a snap hinge of the type illustrated in U.S. Pat. Nos. 5,794,308 and 6,041,477. However, the disclosure is by no means limited to hinges of this type, and other hinge arrangements can be employed.

Figure 2:
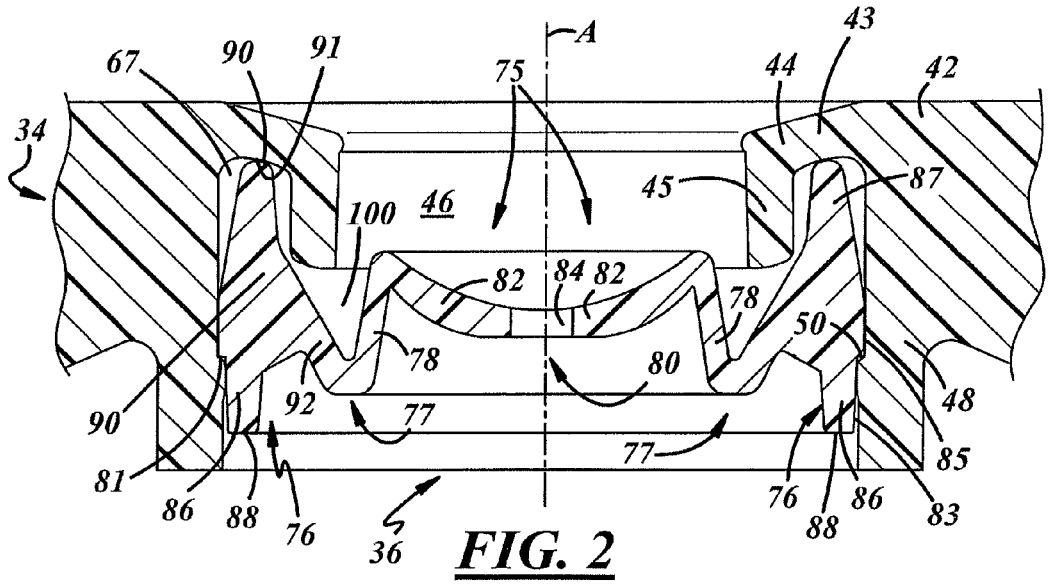
FIG. 2 is a fragmentary sectional view on an enlarged scale of a dispensing assembly of the package illustrated in FIG. 1.
Figure 3:
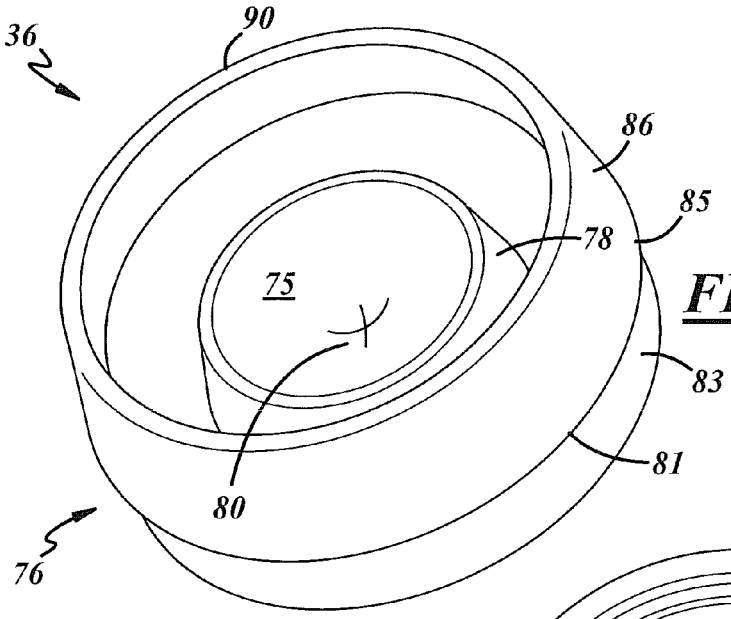
FIG. 3 is a top perspective view of the dispensing valve of the package of FIG. 1.
Figure 4:
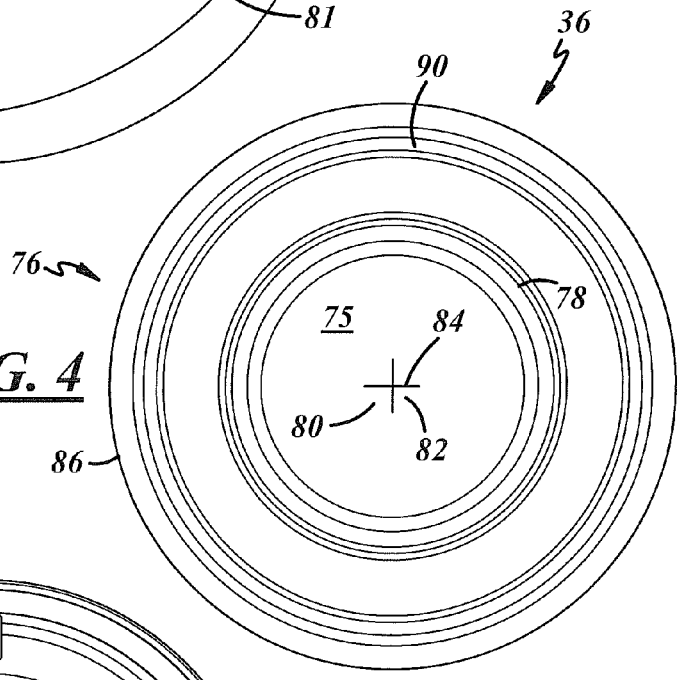
FIG. 4 is a top view of a dispensing valve of the package of FIG. 1.
Figure 5:
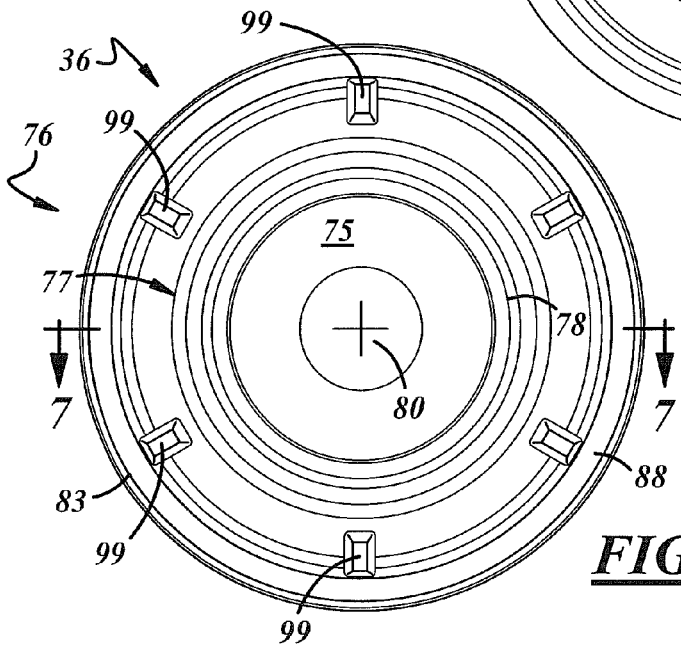
FIG. 5 is a bottom view of the dispensing valve of the package of FIG. 1.
Figure 6:
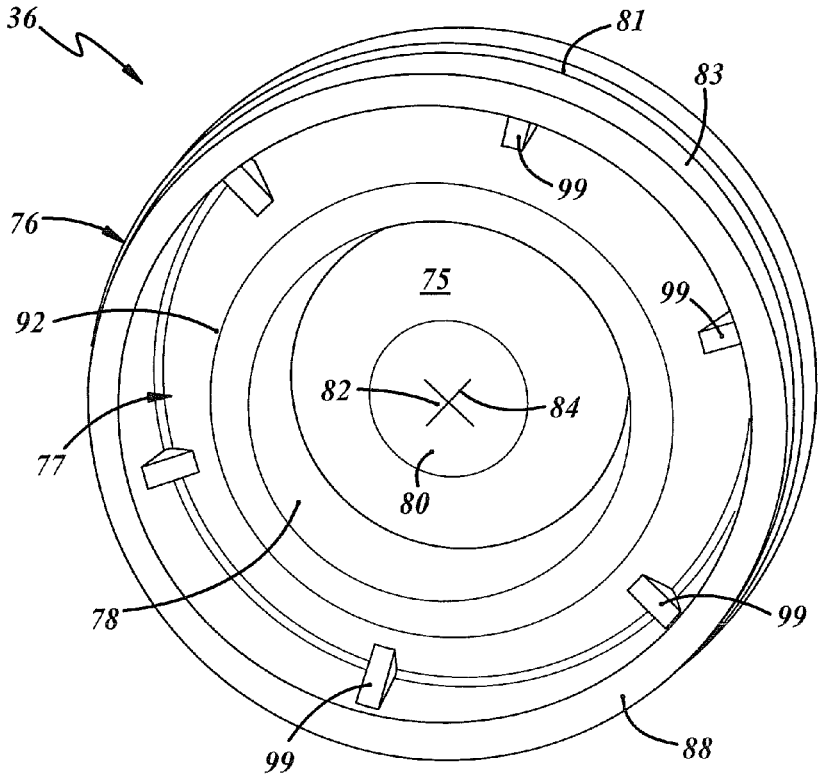
FIG. 6 is a bottom perspective view of the dispensing valve of the package of FIG. 1.
Figure 7:
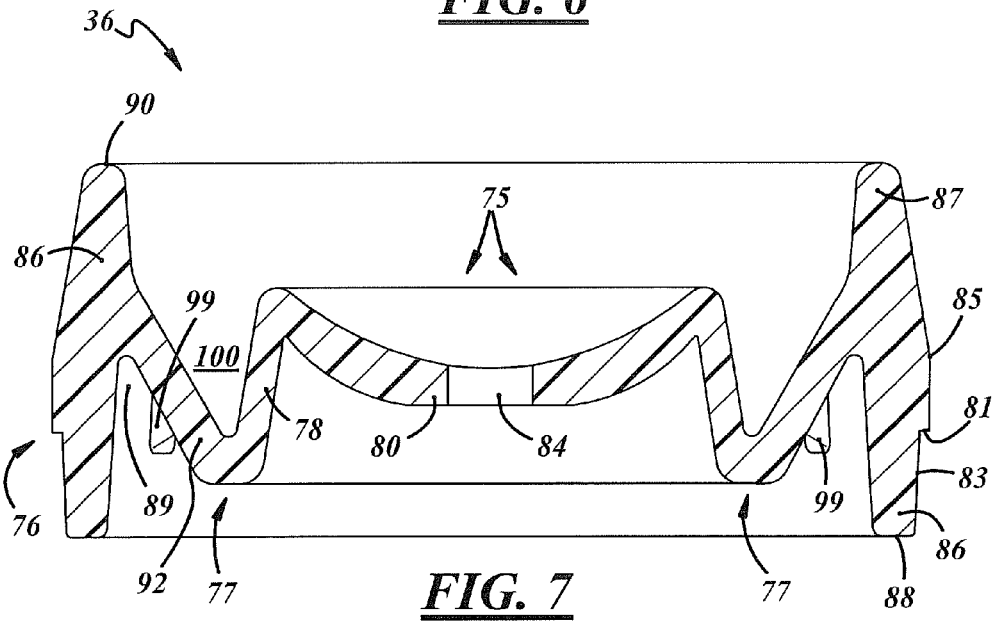
FIG. 7 is a sectional view, taken along line 7-7 of the valve of FIG. 5.

With reference to FIG. 2, the shell 34 includes a deck 42 that may extend substantially perpendicularly to the axis A, and an opening wall 44 extends from the deck 42 and may include a first portion 43 and a second portion 45. The first portion 43 may be flat or, as shown, may have a radially and axially inwardly conical shape, or may be of any other suitable shape. The second portion 45 may be an annular skirt or wall that may extend substantially parallel with the axis A or, as shown, may have an axially inwardly and radially outwardly conical shape, or may be of any other suitable shape. As used herein, terms like substantially and generally may include manufacturing tolerances, variations for good molding practices, and/or the like. A dispensing passage or opening 46 is disposed in the deck 42 and deck opening wall 44, and is preferably centrally positioned. A valve mounting structure, for instance an annular wall 48, may extend axially from the deck 42, surrounding and coaxial with the dispensing opening 46. An annular recess is defined radially between the annular walls 44, 48, wherein the annular wall 44 separates the recess from the dispensing opening 46. The valve 36 may be carried radially outside of the annular wall 44 and radially within the annular wall 48, in the annular recess, and in communication with the dispensing passage or opening 46. An internal engagement feature 50 may be provided on the annular wall 48, and may be either circumferentially continuous or segmented. The feature 50 may be a step, a projection, a bead, or any other suitable feature.

With reference to FIG. 1, the base 38 may include an internal skirt 52 with internal attachment means, such as threads or thread segments 54, for securing the closure shell 34 to the container neck finish 30, and an external skirt 56 that axially extends from a radial periphery of the base 38. The external skirt 56 may be of a geometry to match the geometry of the associated container 22, such as cylindrical in the embodiment illustrated in the drawings. A circumferential array of radially and axially extending ribs 58 may interconnect the skirts 52, 56 for strengthening and rigidifying the closure shell base 38. Single wall closure shells also can be employed. A radially peripheral portion of the deck 42 also includes a ledge 60 that is axially recessed with respect to opening wall 44. The ledge 60 extends entirely around the opening wall 44 in a plane that preferably is perpendicular to the axis A. A radially outwardly extending circumferential bead 62 may extend at least part way around the deck 42 axially adjacent to but spaced from the ledge 60.

The lid 40 includes a base wall 64 and a radially peripheral skirt 66. An edge 68 of the skirt 66 remote from the base wall 64 preferably lies in a plane, and is adapted for edge engagement with the ledge 60 on the base 38 in the closed position of the lid 40. An internal bead 70 preferably extends at least part way around the lid skirt 66 for snap-receipt over the bead 62 to hold the lid 40 in the closed position. An annular bead 72 on the lid base wall 64 contacts an upper surface of the deck 42 of the base 38 in the closed position of the lid 40. As used herein, directional words such as "upper" and "lower" are used by way of description and not limitation with respect to the upright orientation of the closure and package illustrated in FIG. 1. A plug 74 may be disposed radially within the bead 72 and may be disposed adjacent to the valve 36 in the closed position of the lid 40. The plug 74 may be a solid cylinder, crossed walls, or the like. The plug 74 may contact the valve 36 to help prevent the valve 36 from opening when the lid 40 is closed, thereby preventing undesired leakage of product from within the package 20. In one embodiment, the lid 40 need not include the plug 74.

With particular reference to FIG. 2 and general reference to FIGS. 3-7, the valve 36 includes a resiliently flexible center or opening portion 75 through which product may flow, and a resiliently flexible peripheral or mounting portion 76 by which the valve 36 may be at least partially attached or mounted to the closure shell 34 (FIG. 1). The valve 36 also includes a resiliently flexible intermediate or isolating portion 77 coupled between the opening and mounting portions 75, 76.

The isolating portion 77 may at least partially isolates the opening portion 75 from the mounting portion 76 to ensure good working operation of the opening portion 75. For example, the isolating portion 77 may reduce the influence of side pressure on the opening and sealing performance of the opening portion 75.

The opening portion 75 is configured to open and close to allow and block flow of product therethrough. The opening portion 75 includes a radially inward annular wall 78, and a web 80 that extends radially inwardly of the annular wall 78. As used herein, directional words such as "axial," "radial" and "lateral" are taken with respect to a longitudinal axis of a package, which is preferably coaxial with the axis of the container neck finish. Likewise, directional words such as "inward" and "outward" are taken with respect to the package interior. The web 80 may be a circular or disc-like element that extends transversely across the axis A and includes one or more openings through which fluid product may flow.

For example, the web 80 may include two or more valve petals 82 that may be established by two or more slits 84. Because FIG. 2 is a sectional view, only one slit 84 and two petals 82 can be seen, but any suitable quantity of the petals 82 and slits 84 may be provided. In one example, a single straight slit may be provided to establish two straight petals 82. In another example, an omega-shaped slit may be provided to establish a flap. In other examples, the web 80 may include one or more other types of openings instead of or in addition to the slit(s) 84, for instance, one or more self-sealing apertures, flaps, or the like. The web 80 may be dish-shaped or concave-shaped to extend both axially and radially inwardly from an axially outward end of the wall 78. However, the web 80 may be of any suitable shape and configuration. As used herein, the terminology transverse includes being disposed at any angle with respect to an axis including, but not limited to, a perpendicular orientation. The wall 78 extends radially inwardly from the web 80 and may also extend radially outwardly from the web 80 so as to have a conical shape.

The mounting portion 76 is configured to couple the valve 36 to the annular wall 48 of the closure shell 34. The mounting portion 76 may be annular in shape and disposed at a radially outward periphery of the valve 36. In this embodiment, the mounting portion 76 includes an annular leg or wall 86 that extends from an axially inward surface 88 of the valve 36 to an axially outward surface 90 of the valve 36 in a radially inward direction so as to have a substantially conical shape.

Accordingly, and with reference to FIG. 2, a radial space 67 may be established between the axially outward end of the mounting portion 76 and the annular wall 48 of the closure shell base 38. Also, the axially outward surface 90 may be in sealing contact with a corresponding axially inward surface 91 of the closure shell 34. The wall 86 of the mounting portion 76 includes the axially inward surface 88, a first cylindrical surface 83 adjacent the surface 88, a second cylindrical surface 85, and an external engagement feature 81 between the surfaces 83, 85 for positive retention of the valve 36 to the annular wall 48 of the closure shell 34 via the engagement feature 50. The feature 81 may be a step, a projection, or any other suitable feature. The wall 86 may have a conical outer profile that may extend axially outwardly from the cylindrical surface 85 to the axially outward surface 90. The conical outer profile may be disposed at a radially inward angle of about ten degrees with respect to the axis A. The wall 86 may include a crown or annular rib 87 extending into the annular recess between the annular walls 44, 48 for movement radially inwardly and outwardly within the recess as a function of motion of the central portion 80 of the dispensing valve 36 thereby to limit axial movement of the central portion 80 during dispensing and venting of the valve 36. The annular rib 87 includes a conical outer surface disposed at a radially inward angle with respect to the longitudinal axis A of the dispensing valve 36, and a conical inner surface disposed at a radially outward angle with respect to the axis A.

The isolating portion 77 may be configured to flexibly couple the opening portion 75 to the mounting portion 76 so as to at least partially isolate the opening portion 75 of the valve from the mounting portion 76. Accordingly, any distortion or misalignment of, or pressure on, the mounting portion 76 will have little to no influence on the ability of the petals 82 of the opening portion 75 to properly or correctly seat to one another to seal the valve 36 closed. Also, the isolating portion 77 may include an annular leg or wall 92 that is radially inward with respect to the radially outward annular wall 86, and radially intermediate with respect to the annular wall and the radially inward annular wall 78. The radially intermediate annular wall 92 may include an axially inward end coupled to the radially inward annular wall 78. In particular, the axially inward end of the wall 92 may be coupled directly to an axially inward end of the wall 78. The radially intermediate annular wall 92 may be cantilevered from the radially inward annular wall 78.

The crown or rib 87 may be circumferentially continuous, as shown, or may be circumferentially interrupted. The rib 87 may extend axially outwardly from a junction between the mounting portion wall 86 and the intermediate portion wall 92. The junction may be about axially level with an axial outermost extend of the opening portion 80, such that rib 87 extends axially outwardly with respect to the web 80. The rib 87 may include a portion of the conical outer surface of the wall 86, a radially oppositely disposed radially inward surface, and the axially outward surface 90, which may have a radiused profile. The radially inward surface of the rib 87 may have a conical inner profile disposed at a radially outward angle of about five degrees with respect to the axis A.

The isolating portion 77 also includes a plurality of ribs 99 extending between the mounting and isolating portions 76, 77. More specifically, the ribs 99 may extend between the radially outer and intermediate walls 86, 92. Thus, the ribs 99 extend at least partially into the space 89 between the mounting and isolation portions 76, 77. The ribs 99 may provide additional resiliency to the valve 36.

The intermediate annular wall 92 may extend axially outwardly and terminate in an axially outward end that may be coupled to the mounting portion 76. More specifically, the axially outward end of the intermediate annular wall 92 may be coupled directly to an axially outward end of the mounting portion 76. The intermediate annular wall 92 also may extend radially outwardly, wherein the intermediate annular wall 92 and the mounting portion 76 form an inverted V-shaped annular portion that is disposed radially outwardly of the opening portion 75. Accordingly, a wedge-shaped radial space 89 may be established between the mounting portion 76 and the intermediate annular wall 92. Also, the inward and intermediate annular walls 78, 92 also may form a V-shaped structure. Accordingly, a wedge-shaped radial space 100 may be established between the annular walls 78, 92. The radially outward annular wall 86 may be cantilevered from the radially intermediate annular wall 92.

With reference to FIG. 1, the dispensing assembly 24 may be produced in any suitable manner. The shell 34 may be manufactured by injection or compression molding, or in any other suitable fashion. Also, the valve 36 may be injection or compression molded and then cut or formed in a downstream operation to establish the slit(s) 84, or may be manufactured in any other suitable manner. The isolating portion 77 may assist in maintaining good recombination or seating between the valve petals 82 during and after slitting of the web 80 to establish the slit(s) 84.

Furthermore, the valve 36 may be assembled to the closure shell 34 in any suitable manner. For example, the closure shell 34 may be held by a die, holder, or other tool (not shown) in any suitable fashion, and the valve 36 may be inserted within the annular wall 48 by another tool (not shown) from an axially inward side of the closure shell base 38 and retained thereto by the engagement feature 50, by friction, by crimping, and/or any other suitable means. In another example, the valve 36 may be held by a die, holder, or other tool (not shown) in any suitable fashion, and the closure shell 34 may be placed over the valve 36 so that the annular wall 48 envelops the valve 36 and is retained thereto by the engagement feature 50 and/or by friction.

In any event, the peripheral or mounting portion 76 is attached to the closure base 38 such that the annular rib 87 extends into the annular recess between the walls 44, 48 for movement radially inwardly and outwardly within the recess as a function of motion of the central or opening portion 75 of the dispensing valve 36. Also, the valve 36 is mounted to the base 38 such that the center or opening portion 75 is disposed radially within the annular wall 44.

In one example of use, and still referring to FIG. 1, the container 22 is filled with product to be dispensed with the dispensing assembly 24 removed. The dispensing assembly 24 is then secured to the container neck finish 30. The package 20 may be shaken to prepare the product for dispensing. Shaking of the package 20 does not result in spillage or ejection of product because of the valve 36.

The user may squeeze and thereby pressurize the container body 28 to move product through the valve 36. Under such pressure, the valve 36 may resiliently flex to allow product to move therethrough. For example, at least a portion of the wall 78 may resiliently flex radially outwardly into the radial space 100. In another example, at least a portion of the intermediate annular wall 92 may resiliently flex. In any case, the valve 36 may move during dispensing such that the crown or rib 87 flexes in a radially outward direction and contacts the annular wall 48 to limit axial movement of the opening portion 80 of the valve 36.

When the desired amount of product has been dispensed, the container body 28 may be released. The vacuum produced by the container body 28 returning to its original shape may cause some product to be withdrawn or pulled back through the valve 36 for a clean shut-off of product and a clean dispensing opening 46. The valve 36 may move during such venting such that the crown or rib 87 flexes in a radially inward direction and contacts the inner annular wall 44 to limit axial inward movement of the web 80 of the valve 36. Thereafter, one or more portions of the valve 36 may return to a rest position. For example, one or more of the walls 78, 92, rib 87, and/or opening portion 80 may resiliently return to rest positions.

When a user releases a container body, the valve design of the present disclosure reduces or prevents the valve or portions thereof from being pulled into the package under vacuum generated during release of pressure on the package. More specifically, such pulling forces can be resisted by the interference between the crown or rib 87 and the opening wall 44. Therefore, the valve 36 will remain in position and the petals 82 will properly seal to one another to close the valve 36.

There have thus been disclosed a dispensing valve, dispensing assembly, and package that fully achieve one or more of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A dispensing valve system comprising a base of plastic construction, said base having a dispensing opening, an annular recess surrounding said dispensing opening, and a first annular wall separating said recess from said dispensing opening, and a dispensing valve of one-piece one-material flexible resilient molded plastic construction, said dispensing valve including:

a center portion disposed within said annular wall and having at least one dispensing slit extending through the center portion to form at least two petals, and a peripheral portion attached to said base and including an annular rib extending into said annular recess, the annular rib configured to move radially inwardly and outwardly within said recess as a function of motion of said central portion of said dispensing valve thereby to limit axial movement of said central portion during dispensing and venting at said valve.

2. The valve system set forth in claim 1 wherein said annular rib includes a conical outer surface disposed at a radially inward angle with respect to a longitudinal axis of said dispensing valve, and a conical inner surface disposed at a radially outward angle with respect to said axis.

3. The valve system set forth in claim 1 wherein said annular rib extends axially outwardly with respect to said central portion.

4. A dispensing valve system comprising a resiliently flexible mounting portion;

a resiliently flexible opening portion disposed radially inwardly of said mounting portion; and a resiliently flexible intermediate portion disposed radially between and coupled to said mounting and opening portions, and extending both radially outwardly and axially to form a V-shaped portion and to form a first radial space between said opening and intermediate portions, and spaced radially inwardly of said mounting portion to form a second radial space between said mounting and intermediate portions, wherein said mounting portion includes an annular rib extending axially outward with respect to said opening portion to limit axial movement of said opening portion during dispensing and venting at said valve system, and the opening portion includes a web and an annular wall, the web including at least two petals formed by at least one slit that extends through the web, and the annular wall arranged to extend outwardly in the radial direction and inwardly in the radial direction from the web to form the V-shaped portion with the intermediate portion.

5. The valve system set forth in claim 4 wherein said annular rib includes a conical outer surface disposed at a radially inward angle with respect to a longitudinal axis of said dispensing valve system, and a conical inner surface disposed at a radially outward angle with respect to said axis.

6. The valve system set forth in claim 4 wherein said annular rib extends axially outwardly with respect to said opening portion.

7. The valve system set forth in claim 4 wherein said opening and intermediate portions form the V-shaped portion radially outward of a web of said opening portion.

8. The valve system set forth in claim 4 wherein said mounting portion and said intermediate portion form an inverted V-shaped portion radially outward of said opening portion.

9. The valve system set forth in claim 4 wherein said mounting portion extends to an axially outward end in an axially outward and radially inward direction, and said intermediate portion extends from said axially outward end in an axially and radially inward direction to an axially inward end, and said opening portion includes a radially inward annular wall extending from said axially inward end in an axially outward and radially inward direction to a web of said opening portion.

10. The valve system set forth in claim 9 wherein said mounting portion includes an axially inward-most surface of said valve system.

11. The valve system set forth in claim 4 wherein said mounting portion extends radially outwardly from an axial outward end of said intermediate portion.

12. The valve system set forth in claim 11 wherein said mounting portion extends axially inwardly with respect to said axial outward end of said intermediate portion.

13. The valve system set forth in claim 4 further comprising a plurality of ribs extending between said mounting and intermediate portions.

14. The valve system set forth in claim 4 wherein said mounting portion includes a radially outer wall having a cylindrical mounting surface and having a conical outer profile extending axially outwardly from said cylindrical surface.

15. The valve system set forth in claim 14 wherein said outer wall includes an external engagement feature.

16. A dispensing assembly including the dispensing valve system of claim 4.

17. The dispensing assembly set forth in claim 16, wherein a closure shell base includes a deck having an opening wall establishing a dispensing opening and also having an axially inwardly extending annular wall to receive said mounting portion of said valve system.

18. The dispensing assembly set forth in claim 17 wherein said opening wall extends axially inwardly with respect to said deck and is conical in shape.

19. The dispensing assembly set forth in claim 17, wherein a closure shell base includes a deck and having an axially inwardly extending annular wall to receive said mounting portion of said valve system and having an opening wall establishing a dispensing opening and extending axially inwardly and radially outwardly.

20. The dispensing valve system set forth in claim 4, wherein said mounting portion includes a radially outward annular wall, and said intermediate portion includes at least a radially intermediate annular wall.

21. The dispensing valve system set forth in claim 20, wherein said radially outward annular wall is cantilevered from said radially intermediate annular wall.

22. The dispensing valve system set forth in claim 4, wherein said annular rib is extendable into an annular recess of a closure housing for movement radially inwardly and outwardly within said recess as a function of motion of said opening portion of said dispensing valve system.

23. A package including a dispensing assembly having the dispensing valve system set forth in claim 4.

24. A package including a container and the dispensing assembly set forth in claim 23 coupled to said container.

25. A dispensing assembly comprising a dispensing valve system including a resiliently flexible mounting portion; a resiliently flexible opening portion disposed radially inwardly of said mounting portion; and a resiliently flexible intermediate portion disposed radially between and coupled to said mounting and opening portions, and extending both radially outwardly and axially to form a V-shaped portion and to form a first radial space between said opening and intermediate portions, and spaced radially inwardly of said mounting portion to form a second radial space between said mounting and intermediate portions, wherein said mounting portion includes an annular rib extending axially outward with respect to said opening portion to limit axial movement of said opening portion during dispensing and venting at said valve system, wherein a closure shell base includes a deck having an opening wall establishing a dispensing opening and also having an axially inwardly extending annular wall to receive said mounting portion of said valve system, wherein said annular wall includes an internal engagement for positive locking with an external engagement feature of said valve system.

26. A dispensing assembly adapted to mount on a neck finish of a container to control discharge of a product stored in the container to surroundings outside of the container through an opening formed in the neck finish, the dispensing assembly comprising a base adapted to mount on the neck finish and formed to include a product-discharge passageway having an inlet channel arranged to receive product discharged from the container through the opening formed in the neck finish and an outlet channel arranged to discharge product to the surroundings outside of the container, and a dispensing valve coupled to the base to lie in the product-discharge passageway and configured to include a movable web formed to include a normally closed expandable discharge aperture and arranged to move axially along a central axis extending along and through the product-discharge passageway relative to the base between a normally closed state in which the expandable discharge aperture is closed and an opened state in which the expandable discharge aperture is opened during flow of product through the product-discharge passageway and the expandable discharge aperture in the opened state of the movable web, wherein the base includes a first annular wall formed to define the outlet channel and a second annular wall formed to define the inlet channel and arranged to surround the first annular wall to define therebetween a downwardly opening recess lying below a portion of a deck included in the base and communicating with the inlet channel defined by the second annular wall, wherein the dispensing valve further includes a mounting portion coupled to the second annular wall of the base and arranged to surround the movable web, a resiliently flexible intermediate portion arranged to lie between and interconnect the movable web and the mounting portion to support the movable web for up-and-down axial movement along the central axis relative to the mounting portion, and a movable rib coupled to the resiliently flexible intermediate portion and arranged to extend upwardly into the downwardly opening recess formed in the base normally to lie in spaced-apart relation to the second annular wall, and wherein the resiliently flexible intermediate portion is configured to provide upward web-motion control means for moving the movable rib within the downwardly opening recess radially outwardly away from the central axis and toward the second annular wall in response to upward axial movement of the movable web toward an outlet aperture opening into the outlet channel during pressure-actuated flow of product from the inlet channel into the outlet channel through the expandable discharge aperture in the opened state of the movable web to discharge product from the container so that the movable rib engages the second annular wall to limit upward axial movement of the movable web along the central axis relative to the base and the resiliently flexible intermediate portion is also configured to provide downward web-motion control means for moving the movable rib within the downwardly opening recess radially inwardly toward the central axis and toward the first annular wall in response to downward axial movement of the movable web away from the outlet aperture from the opened state to the normally closed state so that the movable rib engages the first annular wall to limit axial movement of the movable web along the central axis relative to the base.

27. The dispensing assembly of claim 26, wherein the first and second annular walls included in the base cooperate to provide the downwardly opening recess with an annular shape.

28. The dispensing assembly of claim 27, wherein the movable rib has an annular shape.

29. The dispensing assembly of claim 27, wherein the movable rib has a radially outwardly facing surface arranged to face toward the second annular wall and the radially outwardly facing surface is arranged normally to lie in spaced-apart relation to the second annular wall when the movable web is in the normally closed state and to engage the second annular wall when the movable web is in the opened state.

30. The dispensing assembly of claim 29, wherein the movable rib has an annular shape.

31. The dispensing assembly of claim 29, wherein the second annular wall has a cylindrical shape and the radially outwardly facing surface has a frustoconical surface.

32. The dispensing assembly of claim 29, wherein the movable rib further includes a radially inwardly facing surface arranged to face toward the first annular wall and an annular axially outward surface arranged to interconnect the radially inwardly and outwardly facing surfaces and lie in sealing contact with a confronting axially inward surface of a ceiling included in the deck and arranged to interconnect the first and second annular wall and form an upper boundary of the downwardly opening recess.

33. The dispensing assembly of claim 32, wherein the radially outwardly facing surface has a frustoconical shape and is disposed at a radially inward angle with respect to the central axis of the dispensing valve and the radially inwardly facing surface has a frustoconical shape and is disposed at a radially outward angle with respect to the central axis of the dispensing valve.

34. The dispensing assembly of claim 29, wherein the radially outwardly facing surface has a frustoconical shape and is disposed at a radially inward angle with respect to the central axis of the dispensing valve.

35. The dispensing assembly of claim 26, wherein the resiliently flexible intermediate portion is coupled to the mounting portion at a junction therebetween and the movable rib is coupled to each of the mounting portion and the resiliently flexible intermediate portion at the junction.

36. The dispensing assembly of claim 35, wherein the junction is arranged to lie in an axially level relation with an axially outermost end of the product-discharge passageway formed in the movable web to cause the movable rib to extend axially outwardly with respect to the product-discharge passageway.

37. The dispensing assembly of claim 36, wherein the deck further includes a ceiling arranged to interconnect the first and second annular walls and form an upper boundary of the downwardly opening recess and the movable rib has an annular shape and is formed to include an annular axially outward surface arranged to lie in sealing contact with the ceiling of the deck.

38. The dispensing assembly of claim 26, wherein the movable web is dish-shaped and includes a concave outer surface communicating with the outlet channel and a convex inner surface communicating with the inlet channel, the expandable discharge aperture extends between the concave outer surface and the convex inner surface, and the resiliently flexible intermediate portion includes a radially inwardly positioned inner frustoconical portion coupled to the movable web and a radially outwardly positioned outer frustoconical portion coupled to the inner frustoconical portion and to the movable rib and the mounting portion at a junction therebetween.

39. The dispensing assembly of claim 38, wherein the inner and outer frustoconical portions cooperate to define an annular wedge-shaped radial space therebetween and the first annular wall is arranged to extend downwardly into the annular wedge-shaped radial space.

40. The dispensing assembly of claim 26, wherein the movable rib has a radially inwardly facing surface arranged to face toward the first annular wall and the radially inwardly facing surface is arranged normally to lie in spaced-apart relation to the first annular wall when the movable web is in the normally closed state and to engage the first annular wall when the movable web is in a released state during movement from the open state to the closed state.

41. The dispensing assembly of claim 40, wherein the first annular wall has a cylindrical shape and the radially inwardly facing surface of the movable rib has a frustoconical portion.

42. The dispensing assembly of claim 41, wherein the movable rib has a radially outwardly facing surface having a frustoconical shape that is disposed at a radially inward angle with respect to the central axis of the dispensing valve and the radially inwardly facing surface of the movable rib has a frustoconical portion that is disposed at a radially outward angle with respect to the central axis of the dispensing valve.

43. The dispensing assembly of claim 26, wherein the base includes a third annular wall arranged to define the inlet channel and a ridge arranged to extend between the second and third annular walls and the mounting portion of the dispensing valve includes an external engagement feature arranged to mate with the ridge.

44. The dispensing assembly of claim 43, wherein the external engagement feature has an annular shape.

45. The dispensing assembly of claim 44, wherein the mounting portion has a radially outwardly facing upper wall mating with the second annular wall and a radially outwardly facing lower wall mating with the third annular wall.

* * * * *